US008689693B2

(12) United States Patent
Prelic et al.

(10) Patent No.: US 8,689,693 B2
(45) Date of Patent: Apr. 8, 2014

(54) ACTIVE BODY

(75) Inventors: Nenad Prelic, Anger (DE); Heribert Eglauer, Berchtesgaden (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 0 days.

(21) Appl. No.: 13/380,959

(22) PCT Filed: Jun. 15, 2010

(86) PCT No.: PCT/EP2010/003565

§ 371 (c)(1),
(2), (4) Date: Mar. 19, 2012

(87) PCT Pub. No.: WO2010/149288

PCT Pub. Date: Dec. 29, 2010

(65) Prior Publication Data

US 2012/0160121 A1 Jun. 28, 2012

(30) Foreign Application Priority Data

Jun. 26, 2009 (DE) ..... 10 2009 030 870

(51) Int. Cl.
*F42B 4/26* (2006.01)
*F42B 12/36* (2006.01)

(52) U.S. Cl.
USPC ..... 102/336; 102/345

(58) Field of Classification Search
USPC ..... 102/336, 341, 345, 352, 360, 338, 335
See application file for complete search history.

(56) References Cited

U.S. PATENT DOCUMENTS

| | | | | |
|---|---|---|---|---|
| 2,678,603 | A | | 5/1954 | Prince, Jr. et al. |
| 2,787,217 | A | | 4/1957 | Mahaffie |
| 3,216,410 | A | | 11/1965 | Trombatore et al. |
| 3,628,416 | A | | 12/1971 | Kernan |
| 3,760,729 | A | | 9/1973 | Freeman |
| 4,002,122 | A | | 1/1977 | Gould |
| 4,060,435 | A | * | 11/1977 | Schroeder ..... 149/19.2 |
| 4,068,591 | A | | 1/1978 | Betts |
| 4,096,804 | A | | 6/1978 | Bilsbury |

(Continued)

FOREIGN PATENT DOCUMENTS

| | | | |
|---|---|---|---|
| CA | 2146015 | A1 | 2/1995 |
| DE | 649 530 | C | 8/1937 |

(Continued)

OTHER PUBLICATIONS

Written Opinion of the International Searching Authority in PCT/EP2010/003565 (English Translation Jan. 2012; WIPO).*

(Continued)

*Primary Examiner* — James Bergin
(74) *Attorney, Agent, or Firm* — Griffin & Szipl, P.C.

(57) ABSTRACT

An active body (1) includes flares (2, 6, 7) arranged adjacent, above, or behind each other, wherein at least one hydrophobic separating layer (3, 5) is integrated between the flares, or flare disks (2, 6, 7), thereby preventing the flares (2, 6, 7) from attaching or sticking. In one embodiment, the hydrophobic separating layer (3) is applied to at least one side of the flares (2), preferably as a powder preferably consisting of microspheres, or the like. In another embodiment, a separating disk is disposed between the flares (6, 7) as the separating layer (5), which in addition is anti-cohesive and anti-adhesive.

19 Claims, 1 Drawing Sheet

(56) References Cited

U.S. PATENT DOCUMENTS

| | | | | |
|---|---|---|---|---|
| 4,374,494 | A | 2/1983 | Maury | |
| 4,409,898 | A | 10/1983 | Blix et al. | |
| 4,624,186 | A | 11/1986 | Widera et al. | |
| 4,838,167 | A | 6/1989 | Prahauser et al. | |
| H778 | H * | 5/1990 | Carlton et al. | |
| 5,074,216 | A | 12/1991 | Dunne et al. | |
| 5,635,666 | A * | 6/1997 | Bannasch et al. | 102/334 |
| 5,929,369 | A | 7/1999 | Bissig et al. | |
| 5,992,327 | A | 11/1999 | Wardecki et al. | |
| 6,055,909 | A | 5/2000 | Sweeny | |
| 6,427,599 | B1 * | 8/2002 | Posson et al. | 102/336 |
| 6,513,438 | B1 | 2/2003 | Fegg et al. | |
| 6,659,012 | B1 | 12/2003 | Grassl et al. | |
| 6,666,351 | B1 | 12/2003 | Hartz et al. | |
| 7,343,861 | B1 | 3/2008 | Baker | |
| 7,363,861 | B2 | 4/2008 | Brune et al. | |
| 7,421,950 | B2 | 9/2008 | Dillard et al. | |
| 7,516,700 | B1 | 4/2009 | Callaway | |
| 7,584,702 | B1 | 9/2009 | Sutherland et al. | |
| 7,866,265 | B1 * | 1/2011 | Kravel et al. | 102/336 |
| 7,992,496 | B2 | 8/2011 | Dillard et al. | |
| 8,146,504 | B2 | 4/2012 | Wallner et al. | |
| 8,276,518 | B2 | 10/2012 | Dillard et al. | |
| 2002/0011173 | A1 * | 1/2002 | Schildknecht et al. | 102/478 |
| 2003/0116050 | A1 | 6/2003 | Brum et al. | |
| 2004/0139876 | A1 | 7/2004 | Wilson et al. | |
| 2004/0244626 | A1 | 12/2004 | Ehmig | |
| 2006/0032391 | A1 | 2/2006 | Brune et al. | |
| 2006/0201372 | A1 | 9/2006 | Nicolae | |
| 2007/0039505 | A1 | 2/2007 | Dillard et al. | |
| 2009/0007768 | A1 | 1/2009 | Wallner et al. | |
| 2009/0095186 | A1 | 4/2009 | Dillard et al. | |
| 2009/0301336 | A1 | 12/2009 | Wardercki et al. | |
| 2010/0288111 | A1 | 11/2010 | Kunz | |
| 2011/0146520 | A1 | 6/2011 | Guth | |
| 2011/0174182 | A1 | 7/2011 | Guth et al. | |
| 2012/0137913 | A1 | 6/2012 | Prelic et al. | |

FOREIGN PATENT DOCUMENTS

| | | | |
|---|---|---|---|
| DE | 2359758 | C1 | 7/1988 |
| DE | 94 14 263 | U1 | 10/1994 |
| DE | 197 56 204 | C1 | 3/1999 |
| DE | 199 10 074 | A1 | 9/2000 |
| DE | 199 51 767 | A1 | 5/2001 |
| DE | 103 23 531 | B3 | 2/2005 |
| DE | 10 2005 020 159 | A1 | 11/2006 |
| DE | 10 2006 004 912 | A1 | 7/2007 |
| DE | 196 49 892 | A1 | 7/2008 |
| DE | 10 2007 032 112 | A1 | 1/2009 |
| DE | 10 2009 020558 | A1 | 11/2010 |
| DE | 10 2009 030 868 | A1 | 1/2011 |
| EP | 0 204 115 | A2 | 12/1986 |
| FR | 715 614 | A | 12/1931 |
| GB | 250 271 | A | 10/1926 |
| JP | 11173796 | A | 7/1999 |
| WO | 00/19164 | A1 | 4/2000 |
| WO | 2007/087948 | A1 | 8/2007 |
| WO | 2010/003496 | A1 | 1/2010 |
| WO | 2010/019291 | A1 | 12/2010 |

OTHER PUBLICATIONS

International Search Report and IPRP issued in PCT/EP2010/003565, completed Aug. 31, 2010 and mailed Sep. 7, 2010.

International Search Report and IPRP issued in PCT/EP2010/003566, completed Aug. 27, 2010 and mailed Sep. 7, 2010.

International Search Report and IPRP issued in PCT/EP2010/003567, completed Sep. 16, 2010 and mailed Sep. 22, 2010.

International Search Report issued in International Application No. PCT/EP20091004113, completed Sep. 29, 2009, mailed Oct. 6, 2009.

International Search Report issued in International Application No. PCT/EP20091004114, completed Oct. 1, 2009, mailed Oct. 13, 2009.

International Search Report issued in corresponding application PCT/EP2010/002332, completed Jun. 29, 2010 and mailed Jul. 6, 2010.

Office Action issued in U.S. Appl. No. 13/291,281 on Sep. 5, 2013.

McGraw-Hill Dictionary of Scientific and Technical Terms (Sixth Ed.) 814 (2003).

"United States Naval Pyrotechnical Compositions," at http://www.google.com/urlsa=t&rct=j&q=&esrc=s&source=web&cd=9&ved=0CGYQFjAl&url=http%3A%2F%2Fwww.ammunitionpages.com%2Fdownload%2F237%2FUS%2520navy%2520pyrotechnicspdf&ei=zjI6UsagMLXi4AOnw4Fw&usg=AFQjCNGhmOURaXkLjZAol124l0jajOvmlg&sig2=vw04ff4-VMe_PYiiD8aZzw&bvm=bv.52434380,d.dmg (downloaded Sep. 18, 2013, five pages).

S.M. Danali et al., Developments in Pyrotechnics, 60 Defense Science Journal 152-158 (2010).

Clarence W. Gilliam et al., Flare, Igniter and Pyrotechnic Disposal: Red Phosphorous Smokes, Naval Ammunition Depot, AD-A013 182 (1975).

"Pyrotechnic Chemistry," at http://www.islandgroup.com/military/pyrotechnic_chemistry.php (2013)(downloaded Sep. 18, 2013, two pages).

Charles A. Knapp, New Infrared Flare and High-altitude Igniter Compositions, Feltman Research and Engineering Laboratories, Picatany Arsenal (1959).

Rui Shu, Explosive Chemistry: The History and Chemistry of Explosives, Dartmouth Undergraduate Journal of Science 21-23 (2012).

Gao Guangyan, Nitrocellulose Synthesis Outline, at http://www.loneoceans.com/labs/nitrocellulose/ (2012).

Random House Webster's College Dictionary 506 (1991).

* cited by examiner

ACTIVE BODY

This is a National Phase Application in the United States of International Patent Application No. PCT/EP2010/003565 filed Jun. 15, 2010, which claims priority on German Patent Application No. DE 10 2009 030 870.9, filed Jun. 26, 2009. The entire disclosures of the above patent applications are hereby incorporated by reference.

FIELD OF THE INVENTION

The invention relates to a so-called "active body," consisting of individual flares that are arranged alongside one another or one behind the other, and, in particular, to the optimization of flare disk separation by means of a hydrophobic separating layer.

BACKGROUND OF THE INVENTION

One such active body is described briefly in DE 199 51 767 C2, for example, and, in that case, carries out the task of a dual-mode decoy body. The active mass, which emits radiation in the infrared (IR) band, is, in that case, formed from flares. A camouflage and decoy munition of this type for protection of objects against guided missiles, which contains active substances that form smoke and/or decoy targets, is furthermore dealt with in DE 10 2005 020 159 B4.

Red phosphorus (RP) has already been a component of military applications for decades, for example, in smoke grenades for protection of infantry, artillery and watercraft, or aircraft decoy targets with an infrared (IR) effect. The smoke or IR effect is developed by the RP by combustion after corresponding ignition by activation. The RP unit is, itself, traditionally ignited and distributed by means of an ignition or break-up charge, which ensures that the active body or the active mass is ignited and distributed optimally for its respective purpose, that is to say, that the IR decoy target blooms optimally to form a cloud or a decoy target over an area.

However, in conjunction with civil applications, ignition and break-up charges, that is to say, explosives, are undesirable and should not be used in bodies or masses such as these. However, dispensing with a break-up charge has the problem that it is not possible for the IR decoy target to bloom in an ideal manner. New concepts are accordingly required, although these will not be investigated in any more detail here.

Thinking ahead, it should be noted that RP flares with an IR effect are currently produced by application of red phosphorus in conjunction with a binding agent to a mounting film (substrate). This material is shaped in the desired manner (single flare) by stamping, and is stacked for the size of the active body. Until the process of binding has been completed, the individual flares stick to one another in an undesired manner. Since the flares not only have residual moisture but also absorb moisture (they are hygroscopic), these flares often stick to one another in an undesirable manner after processing.

The binding could admittedly be forced by a separate drying process, but this would not prevent permanent adhesion. In order to minimize the residual moisture in the RP flares, the time-controlled and temperature-controlled (complex) drying process is once again tedious, and once again nevertheless results in remaining adhesion. Since, furthermore, the material is hygroscopic, it must be permanently protected against environmental moisture. This condition is satisfied by complex vacuum packages and/or storage in air-conditioned rooms.

However, in any case, ideal blooming of the IR decoy target to form a cloud after activation (i.e., ignition) and deployment of the red phosphorus is made more difficult, and it is even impossible for the alternative ignition and deployment concept for civil aviation and maritime use. However, if optimum blooming is not ensured, this leads to a low radiation yield, a poor radiation profile, and therefore not to an optimum decoy target over an area.

The purpose of the present invention is, therefore, to provide an active body that prevents the disadvantages known from practical use and allows optimum blooming, and not just of the active bodies with a break-up charge. One aim, in this case, is to suppress the adhesion or sticking of the individual flares, which is caused by adhesion as well as residual and environmental moisture.

SUMMARY OF THE INVENTION

The object of the present invention is achieved by the features of a first embodiment, which pertains to an active body (1) consisting of flares (2), which are arranged alongside one another, one above the other or one behind the other, characterized in that at least one hydrophobic (separating) layer (3, 5) is included between the flares or flare disks (2).

Advantageous additional embodiments of the invention are specified as follows.

In accordance with a second embodiment of the present invention, the first embodiment is modified so that the layer (3) can be fitted to the flares (2) on one side or on both sides. In accordance with a third embodiment of the present invention, the first embodiment and the second embodiment are further modified so that the layer (3) is formed by a granulate or powder. In accordance with a fourth embodiment of the present invention, the third embodiment is further modified so that the powder is micro-glass balls.

In accordance with a fifth embodiment of the present invention, the first embodiment, the second embodiment, the third embodiment, and the fourth embodiment are further modified so that the powder is applied to the flares (2) by surface treatment. In accordance with a sixth embodiment of the present invention, the first embodiment is modified so the separating layer (5) is a hydrophobically, anti-cohesively and anti-adhesively coated paper. In accordance with a seventh embodiment of the present invention, the first embodiment, the second embodiment, the third embodiment, the fourth embodiment, the fifth embodiment and the sixth embodiment are further modified so that the flare disks (2, 6, 7) are based on RP (red phosphorus) or NC (nitrocellulose).

The present invention is based on the idea of detaching the flares instantaneously (quickly without delay) and permanently, with minimal throughput times and operating costs in the production process. This is done by the introduction of a hydrophobic material. The adhesion, as well as the sticking, between the individual flares are suppressed by covering the entire surface of the individual flares with a hydrophobic layer, preferably granulate/powder—for example, micro-glass balls. In this case, the adhesion is suppressed permanently, with the hydrophobic character of the material (preferably in the form of granulate)—which is used as the separating layer—ensuring that no sticking occurs even when the environmental humidity is raised.

It is therefore proposed that at least one hydrophobic separating layer be included between the flares in an active body having flares, which are arranged alongside one another, one above the other or one behind the other. The hydrophobic separating layer is preferably provided by a powder, for example, consisting of micro-balls etc., which is applied, or the like, to at least one side of the flares. From the production-engineering point of view, the granulate or powder can be applied to the unstamped flare webs, or, for example, by mixing of granulate and the flares in a mixing drum. A person skilled in the art will be aware of alternatives.

In a further variant of the invention, a separating disk is located as a separating layer between the flares, and additionally has anti-cohesive and anti-adhesive characteristics. An active body design such as this inter alia has the advantage that there is no need for long time-controlled and temperature-controlled processes (e.g., heating-drying). Furthermore, the active bodies can be stored more easily. Furthermore, the RP active mass can be saved by the improved performance of the IR decoy target.

The idea can also be implemented in conjunction with nitrocellulose flares (NC flares) and in conjunction with an active mass mix composed of RP and NC.

BRIEF DESCRIPTION OF THE DRAWINGS

The present invention will be explained in more detail with reference to two exemplary embodiments and drawings, in which.

DETAILED DESCRIPTION OF THE INVENTION

Figure 1:
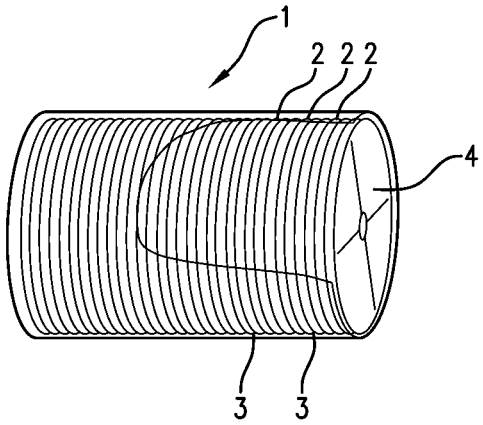
FIG. 1 shows an active body of the present invention, illustrated in a simplified form, consisting of individual flares with a coating.
Figure 2:
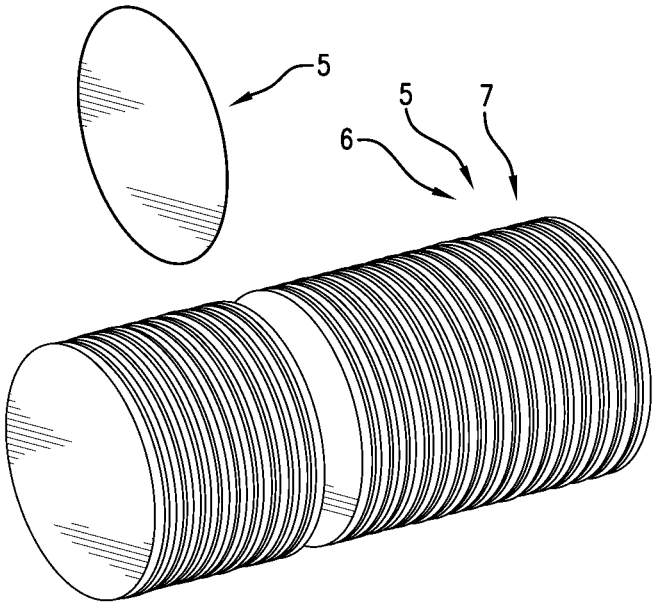
FIG. 2 shows a further embodiment of an active body consisting of individual flares with a separate separating layer.

An active body 1, which is illustrated schematically in FIG. 1 and FIG. 2, is composed of a plurality of flares 2, which in this case (FIG. 1) have already been stamped. FIG. 1 merely indicates a powder layer 3 between the flares 2 (for example, based on nitrocellulose (NC) and/or red phosphorus (RP), which is preferably applied over the entire surface 4 of the respective lower or upper flare 2. "Coating" on both sides of each flare 2 with the powder layer 3 is also feasible. The layer 3 acts as a separating layer between the flares 2, and can be applied to the unstamped flare webs, or can be created by mixing granulate/powder and stamped flares 2, for example, in a mixing drum.

The other variant of an active body, as shown in FIG. 2, indicates a separate separating layer 5 between the actual active mass (flare disks 6, 7). The separating layer 5 can be provided by a hydrophobically, anti-cohesively and anti-adhesively coated paper. These separating layers 5 are stacked between the flare disks 6, 7, in the layer sequence flare disk 6, separating disk 5, flare disk 7, separating layer 5, etc. This allows flare disks 6, 7 to be based on RP or NC, or else RP and NC. In this case, the flare disks 6, 7 need not be round.

The layer structure itself, according to the present invention, can be individually configured, that is to say, alternately uniformly or non-uniformly, in a sequence or as a mix. Furthermore, the disks can also be formed from NC and from RP in this case.

The invention claimed is:

1. An active body comprising:

(a) a plurality of flares that are arranged alongside one another, one above the other or one behind the other; and (b) at least one hydrophobic separating layer disposed between adjacent flares of the plurality of flares so as to separate adjacent flares, wherein the at least one hydrophobic separating layer comprises micro-glass balls.

2. The active body as claimed in claim 1, wherein the at least one hydrophobic separating layer is fitted to each flare of the plurality of flares on one side or on both sides.

3. The active body as claimed in claim 2, wherein the at least one hydrophobic separating layer is formed by a granulate or powder.

4. The active body as claimed in claim 3, wherein the at least one hydrophobic separating layer is formed by the powder, and the powder comprises the micro-glass balls.

5. The active body as claimed in claim 3, wherein the at least one hydrophobic separating layer is formed by the powder, and the powder consists of the micro-glass balls.

6. The active body as claimed in claim 4, wherein the powder is disposed on each flare as a surface treatment layer.

7. The active body as claimed in claim 2, wherein each flare is a disk flare that comprises, as a base, either red phosphorus or nitrocellulose.

8. The active body as claimed in claim 1, wherein the at least one hydrophobic separating layer is formed by a granulate or powder.

9. The active body as claimed in claim 8, wherein the at least one hydrophobic separating layer is formed by the powder, and the powder comprises the micro-glass balls.

10. The active body as claimed in claim 9, wherein the powder is disposed on each flare as a surface treatment layer.

11. The active body as claimed in claim 10, wherein each flare is a disk flare that comprises, as a base, either red phosphorus or nitrocellulose.

12. The active body as claimed in claim 9, wherein each flare is a disk flare that comprises, as a base, either red phosphorus or nitrocellulose.

13. The active body as claimed in claim 8, wherein the at least one hydrophobic separating layer is formed by the powder, and the powder consists of the micro-glass balls.

14. The active body as claimed in claim 8, wherein each flare is a disk flare that comprises, as a base, either red phosphorus or nitrocellulose.

15. The active body as claimed in claim 1, wherein the at least one hydrophobic separating layer comprises a coated paper, wherein the coated paper is a hydrophobically, anti-cohesively and anti-adhesively coated paper.

16. The active body as claimed in claim 15, wherein each flare is a disk flare that comprises, as a base, either red phosphorus or nitrocellulose.

17. The active body as claimed in claim 1, wherein each flare of the plurality of flares is a flare disk.

18. The active body as claimed in claim 17, wherein each flare disk comprises, as a base, either red phosphorus or nitrocellulose.

19. The active body as claimed in claim 1, wherein each flare is a disk flare that comprises, as a base, either red phosphorus or nitrocellulose.

* * * * *